United States Patent [19]

Kalina

[11] Patent Number: 4,489,563

[45] Date of Patent: Dec. 25, 1984

[54] GENERATION OF ENERGY

[76] Inventor: Alexander I. Kalina, 12214 Clear Fork, Houston, Tex. 77077

[21] Appl. No.: 405,942

[22] Filed: Aug. 6, 1982

[51] Int. Cl.[3] ..... F01K 25/06; F01K 25/10

[52] U.S. Cl. ..... 60/673

[58] Field of Search ..... 60/673, 649

[56] References Cited

U.S. PATENT DOCUMENTS

| | | | |
|---|---|---|---|
| 427,401 | 5/1890 | Campbell | 60/673 |
| 3,783,613 | 1/1974 | Billings et al. | 60/38 |
| 4,009,575 | 3/1977 | Hartman, Jr. | 60/648 |
| 4,037,415 | 7/1977 | Christopher | 60/673 |
| 4,101,297 | 7/1978 | Uda | 55/43 |
| 4,183,218 | 1/1980 | Eberly, Jr. | 60/673 |
| 4,195,485 | 4/1980 | Brinkerhoff | 60/673 X |
| 4,297,332 | 10/1981 | Tatani | 423/240 |
| 4,333,313 | 6/1982 | Cardone et al. | 60/673 X |
| 4,346,561 | 8/1982 | Kalina | 60/673 |

FOREIGN PATENT DOCUMENTS

| | | | |
|---|---|---|---|
| 2481362 | 10/1981 | France | 60/673 |
| 48110 | 10/1981 | Japan | 60/673 |
| 294882 | 9/1929 | United Kingdom . | |
| 352492 | 7/1931 | United Kingdom . | |
| 786011 | 11/1957 | United Kingdom . | |
| 872874 | 7/1961 | United Kingdom . | |
| 1085116 | 9/1967 | United Kingdom . | |

OTHER PUBLICATIONS

OTEC Pilot Plant Heat Engine—D. Richards and L. L. Perini, John Hopkins University, 1979.

OTEC—A Comprehensive Energy Analysis—T. C. Carlson et al.

*Primary Examiner*—Allen M. Ostrager

*Attorney, Agent, or Firm*—Arnold, White & Durkee

[57] ABSTRACT

A method of generating energy which comprises utilizing relatively lower temperature available heat to effect partial distillation of at least portion of a multicomponent working fluid stream at an intermediate pressure to generate working fluid fractions of differing compositions. The fractions are used to produce at least one main rich solution which is relatively enriched with respect to the lower boiling component, and to produce at least one lean solution which is relatively improverished with respect to the lower boiling component. The pressure of the main rich solution is increased whereafter it is evaporated to produce a charged gaseous main working fluid. The main working fluid is expanded to a low pressure level to release energy. The spent low pressure level working fluid is condensed in a main absorption stage by dissolving with cooling in the lean solution to regenerate an initial working fluid for reuse.

37 Claims, 6 Drawing Figures

GENERATION OF ENERGY

This invention relates to the generation of energy. More particularly, this invention relates to a method of generating energy in the form of useful energy from a heat source. The invention further relates to a method of improving the heat utilization efficiency in a thermodynamic cycle and thus to a new thermodynamic cycle utilizing the method.

The most commonly employed thermodynamic cycle for producing useful energy from a heat source, is the Rankine cycle. In the Rankine cycle a working fluid such as ammonia or a freon is evaporated in an evaporator utilizing an available heat source. The evaporated gaseous working fluid is then expanded across a turbine to release energy. The spent gaseous working fluid is then condensed in a condenser using an available cooling medium. The pressure of the condensed working medium is then increased by pumping it to an increased pressure whereafter the working liquid at high pressure is again evaporated, and so on to continue with the cycle. While the Rankine cycle works effectively, it has a relatively low efficiency. The efficiency of the typical Rankine cycle is such that currently the cost of installation is in the region of about $1,700 to about $2,200 per Kw.

A thermodynamic cycle with an increased efficiency over that of the Rankine cycle, would reduce the installation costs per Kw. At current fuel prices, such an improved cycle would be commercially viable for utilizing various waste heat sources.

Applicants prior patent application Ser. No. 143,524 filed Apr. 24, 1980 relates to a system for generating energy which utilizes a binary or multicomponent working fluid. This system, termed the Exergy system, operates generally on the principle that a binary working fluid is pumped as a liquid to a high working pressure. It is heated to partially vaporize the working fluid, it is flashed to separate high and low boiling working fluids, the low boiling component is expanded through a turbine to drive the turbine, while the high boiling component has heat recovered therefrom for use in heating the binary working fluid prior to evaporation, and is then mixed with the spent low boiling working fluid to absorb the spent working fluid in a condenser in the presence of a cooling medium.

Applicant's Exergy cycle is compared theoretically with the Rankine cycle in applicant's prior patent application to demonstrate the improved efficiency and advantages of applicant's Exergy cycle. This theoretical comparison has demonstrated the improved effectiveness of applicant's Exergy cycle over the Rankine cycle when an available relatively low temperature heat source such as surface ocean water, for example, is employed.

Applicant found, however, that applicant's Exergy cycle provided less theoretical advantages over the conventional Rankine cycle when higher temperature available heat sources were employed.

It is accordingly an object of this invention to provide an energy generating system which would provide an improved efficiency not only when lower temperature available heat sources are utilized, but also when higher temperature waste or available heat sources are utilized.

In accordance with one aspect of this invention, a method of generating energy comprises:

(a) subjecting at least a portion of an initial multicomponent working fluid stream having an initial composition of lower and higher boiling components, to partial distillation at an intermediate pressure in a distillation system by means of relatively lower temperature heat to generate working fluid fractions of differing compositions;

(b) using the generated fractions to produce at least one main rich solution which is relatively enriched with respect to a lower temperature boiling component, and to produce at least one lean solution which is relatively impoverished with respect to a lower temperature boiling component;

(c) increasing the pressure of the main rich solution to a charged high pressure level and evaporating the main rich solution by means of a relatively higher temperature heat to produce a charged gaseous main working fluid;

(d) expanding the gaseous main working fluid to a spent low pressure level to release energy; and (e) condensing the spent gaseous working fluid in a main absorption stage by dissolving it with cooling in the lean solution at a pressure lower than the intermediate pressure to regenerate the initial working fluid.

In an embodiment of the invention, the relatively lower temperature heat may be selected from one or more members of the group comprising:

(a) a lower temperature portion of the relatively higher temperature heat;

(b) a portion of the relatively higher temperature heat which is not utilized for evaporating the main rich solution;

(c) heat from a relatively lower temperature heat source;

(d) heat recovered from the spent gaseous working fluid; and (e) heat recovered from the main absorption stage.

The relatively lower temperature heat may conveniently be distributed between the distillation system and a lower temperature portion of a main evaporation stage to preheat the main rich solution prior to evaporation thereof in a main evaporation stage.

The method may conveniently include the steps of:

(a) increasing the pressure of the initial working fluid stream to a first intermediate pressure;

(b) dividing the initial working fluid stream into a first neutral stream and a first distillation stream;

(c) subjecting the first distillation stream to partial distillation in the distillation system to produce a first lower boiling fraction and a first higher boiling fraction;

(d) removing the first higher boiling fraction from the distillation system to constitute the lean solution; and (e) absorbing the first lower boiling fraction in the first neutral stream to enrich that stream to produce a first rich solution.

In one preferred embodiment of the invention, the method may including the step of withdrawing the first rich solution from the distillation system to constitute the main rich solution.

This embodiment of the invention would be employed in appropriate circumstances where the heating and cooling mediums which are available and are employed, are such that enrichment of the working fluid can be effected sufficiently in a single distillation stage to produce a main rich solution which can be evaporated effectively with the available relatively higher temperature heat source.

In an alternative embodiment of the invention, where justified by the heating and cooling mediums utilized in practicing the invention, the method may include two, three or more distillation stages in the distillation system with a view to producing a main rich solution which is enriched to a greater extent than in a single stage distillation system.

Thus, for example, where the method includes two distillation steps in the distillation stage, the method may include the step of subjecting the first rich solution to at least one second distillation step by:

(a) mixing with the first rich solution a second higher boiling fraction recycled from a succeeding distillation stage of the distillation system to produce a second working fluid stream;

(b) increasing the pressure of the second working fluid stream to a second higher intermediate pressure;

(c) dividing the second working fluid stream into a second neutral stream and a second distillation stream;

(d) subjecting the second distillation stream to partial distillation in the distillation system to produce a second lower boiling fraction, and to produce the second higher boiling fraction which is recycled and mixed with the first rich solution; and (e) absorbing the second lower boiling fraction in the second neutral stream to produce a second rich solution which has a greater enrichment than the first rich solution.

It will be appreciated that the distillation system can be adjusted and altered in various ways to accommodate the heat sources which are available and to provide the most effective production of rich and lean solution streams for use in the method of this invention.

While the main rich solution may be evaporated partially in the evaporation stage, it is preferred that the main rich solution be evaporated substantially or preferably completely in the main evaporation stage. In this way all heat utilized in evaporating the main rich solution will be effective in providing the charged high pressure working fluid which is available to be expanded and thereby release or generate energy.

If the main rich solution is evaporated only partially, some of the main rich solution which is not evaporated, will have been heated to a relatively high temperature, but will not be available to generate energy. This will therefore reduce the efficiency of the process.

Even if the portion of the main rich solution which is not evaporated is utilized for heat exchange purposes to supply heat to the main rich solution prior to evaporation and/or to supply heat for utilization in the distillation stage, substantial energy losses will occur in the heat exchange system because of the relatively high temperature heat which is involved.

By evaporating the main rich solution substantially completely in a main evaporation state using a relatively high temperature heat, and utilizing all or substantially all of the evaporated main rich solution as the charged gaseous working fluid for releasing energy, applicant believes high temperature energy utilization will be the most efficient.

By using relatively low temperature heat for partial distillation in the distillation system heat losses will be substantially less. Heat losses will naturally still occur in the heat exchanger systems of the distillation system. However, because relatively low temperature heat is being utilized, the quantity of heat loss will be substantially less.

Relatively lower temperature heat for the distillation system of this invention may be obtained in the form of spent relatively high temperature heat, in the form of the lower temperature part of relatively higher temperature heat from a heat source, in the form of relatively lower temperature waste or other heat which is available from the or a heat source, and/or in the form of relatively lower temperature heat which is generated in the method and cannot be utilized efficiently or more efficiently or at all for evaporation of the main rich solution.

In practice, any available heat, particularly lower temperature heat which cannot be used or cannot be used effectively for evaporating the main rich solution, may be utilized as the relatively lower temperature heat for the distillation system. In the same way such relatively lower temperature heat may be used for preheating the main rich solution in a preheater or in a lower temperature part of the main absorption stage.

In one embodiment of the invention, at least part of the lean solution may be used as a second working fluid by having its pressure increased, by being evaporated in a second main evaporator stage, by being expanded to release energy, and by then being condensed with the other spent main working fluid and with any remaining part of the lean solution in an absorption stage.

In this embodiment of the invention, the second working fluid and the main working fluid may be expanded independently, for example, through separate turbines or the like, to release energy.

This embodiment of the invention may be utilized where the higher temperature heat source which is available for use in carrying out the process of this invention, is such that the pressure of the main rich solution could be increased above the capacity of the main evaporator and the turbine or other expansion/energy release means, and yet still be capable of effective evaporation in the main evaporator. In this event the second working fluid which is relatively impoverished with regard to the low boiling components, could be heated first by the high temperature heat source so that it will be evaporated effectively at a lower pressure which is compatible with the pressure capacities of the main evaporator and the turbine. The spent very high temperature heat from such evaporation can then be used in series for evaporating the main rich solution at a convenient pressure. Thereafter, the remaining spent lower temperature heat can be utilized in the distillation system of the invention.

In a similar embodiment of the invention, the initial working fluid stream may be treated in the distillation system to produce in addition to the lean solution, a plurality of rich solution streams having differing compositions. In this embodiment, the rich solution streams may be separately treated to increase their pressures, to evaporate them and to expand them, with the evaporation of each rich solution stream being effected with a heat source temperature range appropriate for the specific composition range of the rich solution stream.

In one preferred application of the method of this invention, the enrichment of portion of the working fluid stream may, in each distillation stage of the distillation system, be increased to the maximum extent possible consistent with effective distillation of the distillation stream in that stage with the available lower temperature heat source, and consistent with effective condensation of the lower boiling fraction in the neutral stream with an available cooling medium in each distillation stage to produce a main rich solution which may be pumped to high pressure prior to effective evaporation.

Various types of heat sources may be used to drive the cycle of this invention. Thus, for example, applicant anticipates that heat sources may be used from sources as high as say 1,000° F. or more, down to heat sources such as those obtained from ocean thermal gradients. Heat sources such as, for example, low grade primary fuel, waste heat, geothermal heat, solar heat and ocean thermal energy conversion systems are believed to all be capable of development for use in applicant's invention.

The working fluid for use in this invention may be any multicomponent working fluid which comprises a mixture of two or more low and high boiling fluids. The fluids may be mixtures of any of a number of compounds with favorable thermodynamic characteristics and having a wide range of solubility. Thus, for example, the working fluid may comprise a binary fluid such as an ammonia-water mixture, two or more hydrocarbons, two or more freons, or mixtures of hydrocarbons and freons.

Enthalpy-concentration diagrams for ammonia-water are readily available and are generally accepted. Ammonia-water provides a wide range of boiling temperatures and favorable thermodynamic characteristics. Ammonia-water is therefore a practical and potentially useful working fluid in most applications of this invention. Applicant believes, however, that when equipment economics and turbine design become paramount considerations in developing commercial embodiments of the invention, mixtures of freon-22 with toluene and other hydrocarbon or freon combinations will become more important for consideration.

The invention further extends to a method of improving the heat utilization efficiency in a thermodynamic cycle using a multicomponent working fluid having components of lower and higher boiling point, which method comprises:

(a) utilizing relatively lower temperature heat to effect partial distillation of at least portion of the working fluid for producing working fluid fractions which have differing compositions; and (b) utilizing relatively higher temperature heat to completely evaporate at least an enriched portion of the working fluid which has been enriched with respect to a lower boiling component, to produce a gaseous working fluid.

The invention furhter extends to a method of generating useful energy from an available heat source, which comprises:

(a) subjecting a multicomponent working fluid having components of differing boiling points, to partial distillation in a distillation stage to produce an enriched working fluid liquid stream which is enriched with respect to a lower boiling point component;

(b) evaporating the stream substantially completely to produce a vaporized charged working fluid; and (c) expanding the charged working fluid to release energy.

Still further in accordance with the invention there is provided a method of generating energy, which comprises:

(a) feeding an initial multicomponent working fluid stream to a partial distillation system;

(b) increasing the pressure of the stream to an intermediate pressure;

(c) separating the stream into a neutral stream and a distillation stream;

(d) subjecting the first distillation stream to partial distillation to produce working fluid fractions of differing compositions;

(e) withdrawing the fraction comprising a lean liquid solution which is impoverished with respect to a lower boiling component, from the distillation stage;

(f) mixing the fraction comprising an enriched vapor which is enriched with respect to a lower boiling component, with the neutral stream and condensing it therein by means of a cooling medium to form an enriched liquid stream;

(g) increasing the pressure of the enriched liquid stream;

(h) substantially evaporating the enriched liquid stream in an evaporation stage to produce a charged working fluid vapor;

(i) expanding the charged working fluid vapor to release energy and produce a spent working fluid vapor; and (j) mixing the spent vapor with the lean liquid solution and condensing it therein in an absorption stage to regenerate the initial working fluid stream.

In general, standard equipment may be utilized in carrying out the method of this invention. Thus, equipment such as heat exchangers, tanks, pumps, turbines, valves and fittings of the type used in a typical Rankine cycles, may be employed in carrying out the method of this invention. Applicant believes that the constraints upon materials of construction would be the same for this invention as for conventional Rankine cycle power or refrigeration systems. Applicant believes, however, that higher thermodynamic efficiency of this invention will result in lower capital costs per unit of useful energy recovered, primarily saving in the cost of heat exchange and boiler equipment. In applications such as geothermal and solar sources, where heat conversion equipment would tend to be a small part of the total investment required to produce or collect heat, the high efficiency of the invention would produce a greater energy output. Therefore, it would reduce the total cost per unit of energy produced.

The expansion of the working fluid from a charged high pressure level to a spent low pressure level to release energy may be effected by any suitable conventional means known to those skilled in the art. The energy so released may be stored or utilized in accordance with any of a number of conventional methods known to those skilled in the art.

In a preferred embodiment of the invention, the working fluid may be expanded to drive a turbine of conventional type.

Preferred embodiments of the invention are now described by way of example with the reference to the accompanying drawings.

Figure 1:
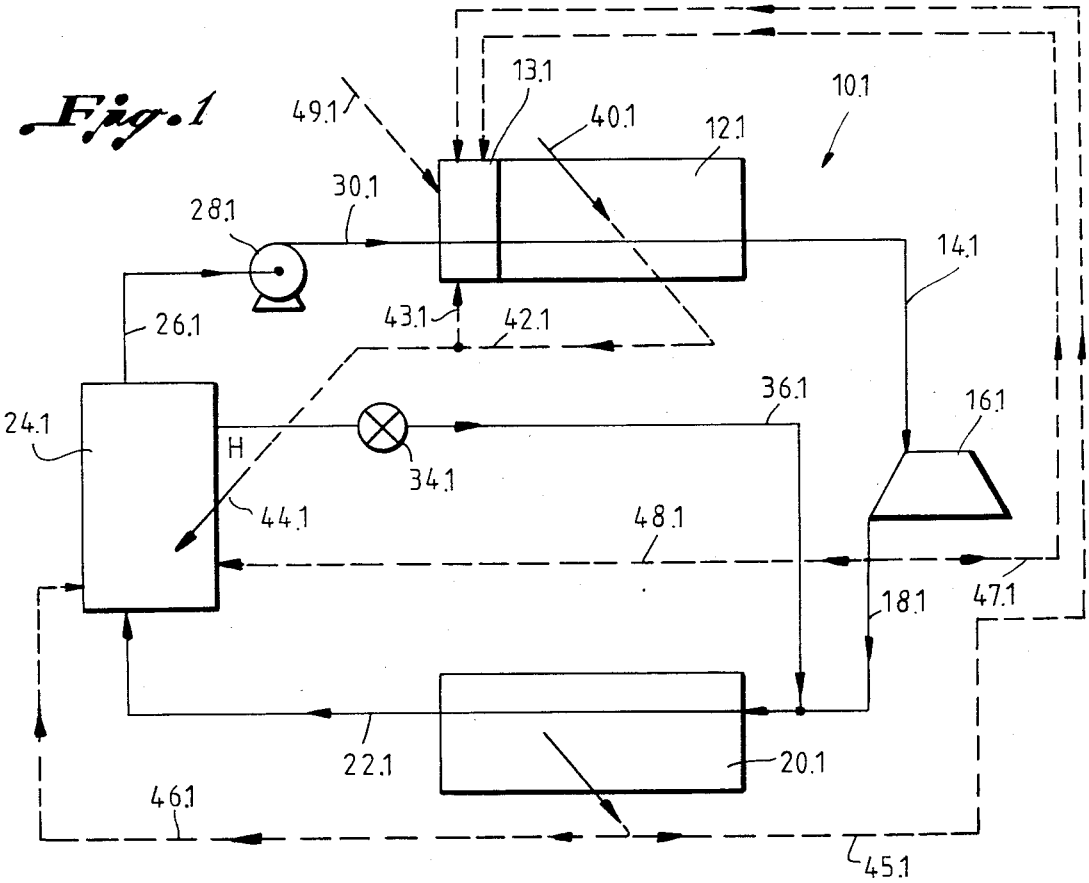
FIG. 1 shows a simplified schematic representation of one system for carry out the method of this invention.

With reference to FIG. 1 of the drawings, reference numeral 10.1 refers generally to one embodiment of a thermodynamic system or cycle in accordance with this invention.

The system or cycle 10.1 comprises a main evaporation stage 12.1, a turbine 16.1, a main absorption stage 20.1, a distillation system 24.1, and a main rich solution pump 28.1.

In use, using an ammonia-water working solution as the binary working fluid, an initial working fluid stream at an initial low pressure will flow from the main absorption stage 20.1 to the distillation system 24.1 along line 22.1. In the distillation system 24.1, the initial working fluid stream would have its pressure increased to an intermediate pressure and would be split into a neutral stream and a distillation stream (not shown in FIG. 1). The distillation stream would be subjected to partial distillation using a low temperature heat source to generate working fluid fractions of differing composition. The fraction which is enriched with respect to the low boiling component, namely enriched with respect to ammonia, would then be added to the first neutral stream and would be condensed in a condenser within the distillation system 24.1 to produce a main rich solution stream leaving the distillation system along line 26.1 and flowing to the main rich solution pump 28.1.

The main rich solution would then be pumped by means of the pump 28.1 to a higher pressure, and then flows along the line 30.1 to the main evaporation stage 12.1 where it is evaporated completely with a relatively higher temperature heat source to form a charged high pressure gaseous working fluid.

The charged gaseous working fluid is then conveyed along line 14.1 to the turbine 16.1 where it is expanded to release energy. The spent gaseous working fluid is then discharged from the turbine 16.1 along the line 18.1 to the main absorption stage 20.1. The working fluid is conveniently expanded to the initial low pressure level.

The fraction of working fluid which is produced in the distillation system 24.1 which is impoverished with respect to the lower boiling component, namely the ammonia, constitutes a high temperature boiling or lean solution stream which leaves the distillation system 24.1 along line 32.1. The lean solution has its pressure reduced across a pressure reducing valve 34.1, and the reduced pressure lean solution flows along line 36.1 to the main absorption stage 20.1.

In the main absorption stage 20.1 the spent gaseous working fluid is condensed by being absorbed into the lean solution while heat is extracted therefrom in the main absorption stage 20.1 by utilizing a suitable available cooling medium.

The relatively higher temperature heat from the waste or other heat source utilized in carrying out the system or cycle of this invention is indicated by reference numeral 40.1. The relatively higher temperature heat 40.1 is fed to the main evaporation stage 12.1 for evaporating the main rich solution completely.

The spent relatively higher temperature heat from the main evaporation stage 12.1 which, because of the conventional pinch point, cannot be utilized efficiently in the main evaporation stage 12.1, now becomes relatively lower temperature heat. This spent heat may therefore be fed along dotted line 42.1 to constitute relatively lower temperature heat 44.1 which is fed to the distillation system 24.1 for effecting partial distillation of the portion of the working fluid in the distillation system.

In addition to the spent relatively higher temperature heat which is fed to the distillation system as the relatively lower temperature heat 44.1, relatively lower temperature heat may also be obtained from another relatively lower temperature available heat source and/or from the heat extracted from the main absorption stage 20.1 as indicated by dotted line 46.1 and/or from heat recovered from the spent gaseous working fluid between the turbine 16.1 and the main absorption stage 20.1 as indicated by dotted line 48.1.

The available heat can be used in a large number of combinations to provide for effective utilization thereof. The way in which the heat will be utilized both for evaporation of the working fluid and for partial distillation in the distillation system 24.1, will therefore vary depending upon the apparatus employed, the capacity of the turbine 16.1, the working fluid employed, the type of heat utilized as the heat source, and the availability of relatively low temperature heat and relatively high temperature heat.

Thus, for example, in the embodiment of FIG. 1, the main evaporation stage 12.1 may include a preheater stage or a low temperature stage 13.1. Relatively lower temperature heat may be fed to the stage 13.1 to preheat the main rich solution prior to evaporation.

Such relatively lower temperature heat may be:

(a) at least portion of the relatively low temperature heat 44.1 which is diverted from dotted line 42.1 and fed to the stage 13.1 along line 43.1;

(b) at least portion of the heat extracted from the higher temperature portion of the main absorption stage 20.1 and fed to the stage 13.1 along line 45.1;

(c) at least portion of the heat recovered from the spent gaseous working fluid downstream of the turbine 16.1 and fed to the stage 13.1 along line 47.1; and/or (d) relatively lower temperature heat from an available heat source and fed to the stage 13.1 along line 49.1.

Figure 2:
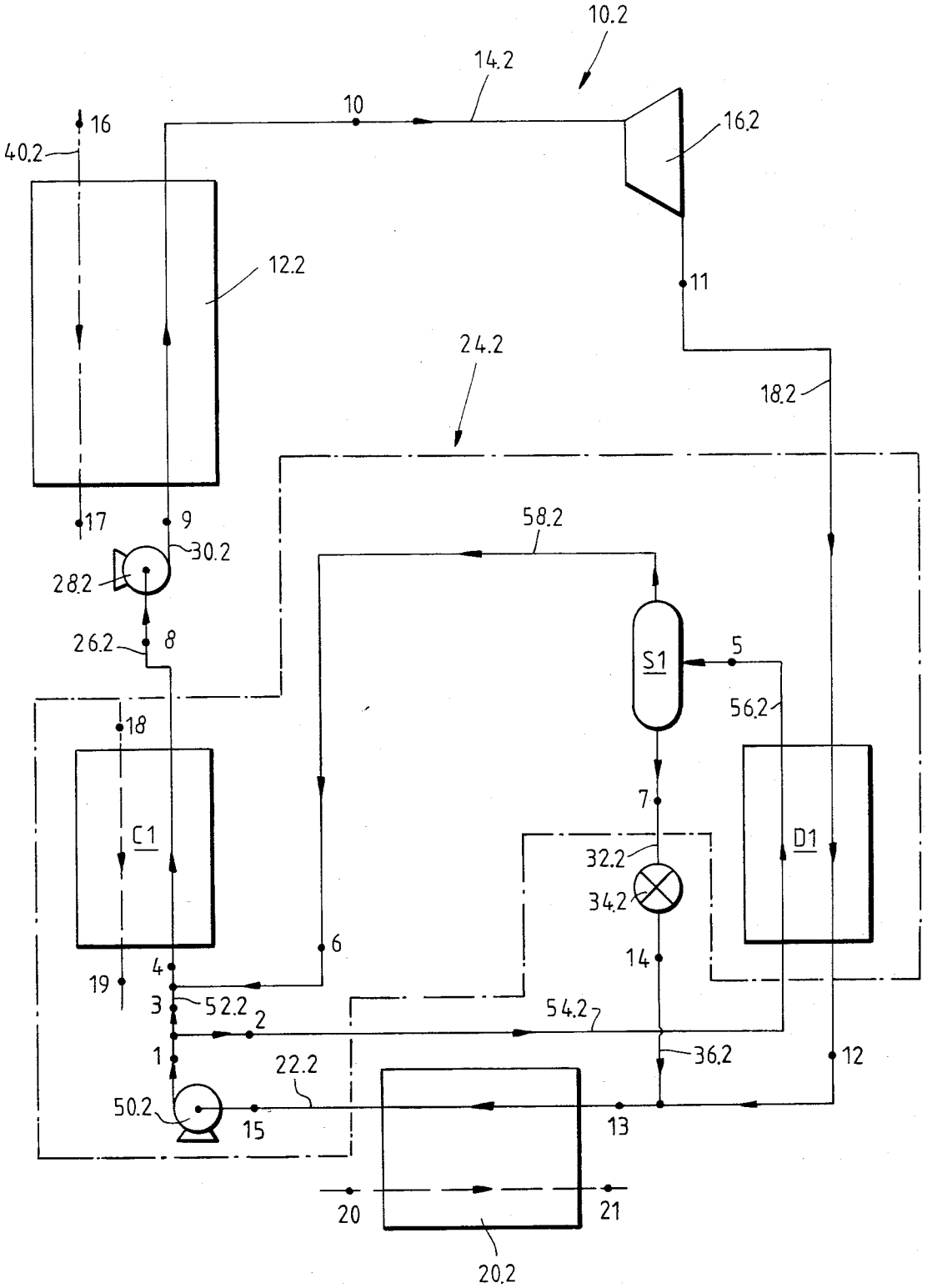
FIG. 2 shows a more detailed schematic representation of one embodiment in accordance with the system of FIG. 1.

With reference to FIG. 2 of the drawings, reference number 10.2 refers to a more detailed schematic representation of a first embodiment of the system of FIG. 1.

The system or cycle 10.2 corresponds essentially with the system 10.1. Corresponding parts are therefore indicated by corresponding reference numerals except that the suffix "0.1" has been replaced by the suffice "0.2."

In the system 10.2, the distillation system 24.2 has been enclosed in a chain dotted line to identify the portions of the system forming the distillation system 24.2.

The initial working fluid stream at an initial low pressure flows along the line 22.2 from the main absorption stage 20.2 into the distillation system 24.2. The initial working fluid stream flows to an intial pump 50.2 where the pressure of the stream is increased to an intermediate pressure.

On the downstream side of the initial pump 50.2, the initial working fluid stream is separated into a first neutral stream which flows along line 52.2, and a first distillation stream which flows along line 54.2.

The distillation system 24.2 includes a first distillation stage D1 which is in the form of a heat exchanger to place the first distillation stream flowing along the line 54.2 in heat exchange relationship with spent gaseous working fluid flowing along the line 18.2.

Relatively lower temperature heat from the spent gaseous working fluid causes partial distillation of the first distillation stream in the first distillation stage D1 to generate working fluid fractions of differing compositions which flow along the line 56.2 to a first separator stage S1.

The first separator stage S1 may be provided by a separator stage of any conventional suitable type known to those skilled in the art.

In the separator stage S1 the working fluid fractions become separated into a lower boiling fraction and a higher boiling fraction. The higher boiling fraction which is impoverished with respect to the ammonia, flows out of the distillation system 24.2 along line 32.2 through the pressure release valve 34.2 and then through the line 36.2 to the main absorption stage 20.2.

The lower boiling fraction which is enriched with respect to the ammonia flows along line 58.2 and is mixed with the first neutral stream flowing along line 52.2 to enrich the first neutral stream. The lower boiling fraction is therefore absorbed in the first neutral stream in a first condensation stage C1 to form a first rich solution stream which leaves the first condensation stage C1.

In the system 10.2, the distillation system 24.2 comprises only a single distillation unit. The first rich solution stream which leaves the first condensation stage C1 therefore constitutes the main rich solution stream which leaves this distillation system 24.2 along the line 26.2 and flows to the main rich solution pump 28.2 where its pressure is increased prior to evaporation in the main evaporation stage 12.2.

In the cycle 10.2, cooling water at ambient temperature is employed both in the main absorption stage 20.2 and in the first condensation stage C1 to effect absorption of gaseous fractions into liquid fractions in these two stages. For the relatively higher temperature heat to effect evaporation of the main rich solution in the main evaporation stage 12.2, exhaust gases from a De Laval diesel engine is utilized to flow along the line 40.2.

A case study was prepared to illustrate the recovery of waste heat from a De Laval diesel engine. Waste heat is available from such an engine in the form of exhaust gas, jacket water and lubrication oil. In the embodiment illustrated in FIG. 2 of the drawings, only the heat available from the exhaust gas was utilized as a heat source since the lower temperature heat was not required.

Figure 3:
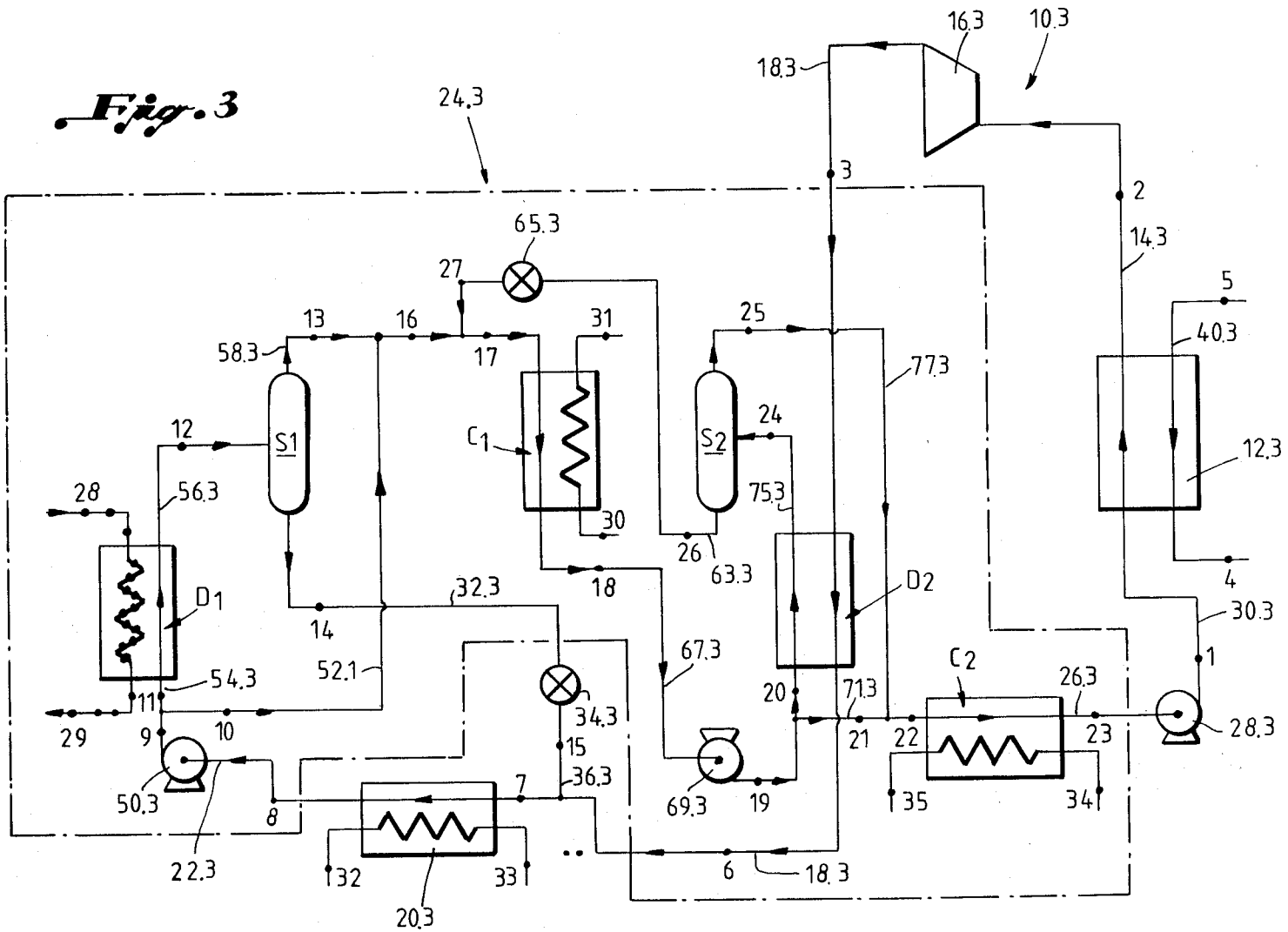
FIG. 3 shows a more detailed schematic representation of an alternative embodiment in accordance with the system of FIG. 1.

In the embodiment illustrated in FIG. 3, however, heat available in the form of exhaust gas as well as heat available in the form of jacket water was utilized as the heat source.

The De Laval engine was a model DSRV-12-4 of Transamerica De Laval, Inc. "Enterprise". It had a gross bhp rating of 7,390 and a net bhp rating of 7,313.

The available heat sources which could be utilized from the waste heat of the De Laval diesel engine are as follows:

| EXHAUST GAS | | |
|---|---|---|
| T1 | 750° F. | 319.9° C. |
| T2 | 200° | 93.3° C. |
| H (heat in exhaust gas above 200° F.) | 12,566,600 BTU/hr. | 3,166,472 Kcal/hr. |

| JACKET WATER | | |
|---|---|---|
| T1 | 175° F. | 79.44° C. |
| T2 | 163° F. | 72.78° C. |
| H | 8,440,300 BTU/hr. | 2,027,130 Kcal/hr. |

| LUBRICATING OIL | | |
|---|---|---|
| T1 | 175° F. | 79.44° C. |
| T2 | 153° F. | 67.22° C. |
| H | 2,413,290 BTU/hr. | 608,139 Kcal/hr. |

EXERGY IN AVAILABLE HEAT SOURCE

Exergy is defined at the initial cooling water temperature of 85° F. and final temperature of 105° F. Exergy in heat sources having an initial temperature less than 160° F. is considered de minimus and has been ignored. The exergy in available heat sources is:

(a) exhaust gas—1,431.4 Kw or 1,230,607 Kw/hr;
(b) jacket water—277.9 Kw or 238,190 Kcal/hr;
(c) lubrication oil—78.3 Kw or 67,329 Kcal/hr;
(d) total—1,787.5 Kw or 1,536,846 Kcal/hr.

In the case study which was performed, the temperatures, pressures and concentrations were ascertained from water-ammonia enthalpy/concentration diagrams which are available in the literature.

The case study which was calculated on the basis of the system 10.2 as illustrated in FIG. 2, had the parameters as set out below in Table 1.

TABLE 1

| Point | Temperature | | Pressure | | Enthalpy | | Concentration | Weight | |
|---|---|---|---|---|---|---|---|---|---|
| No. | °F. | °C. | psia | kg/cm² | BTU/lb | kcal/kg | lb/lb or kg/kg | lb/hr | kg/hr |
| 1 | 95.0 | 35.0 | 42.67 | 3.0 | 21.6 | 12.0 | 0.262 | 42,719.8 | 19,377.4 |
| 2 | 95.0 | 35.0 | 42.67 | 3.0 | 21.6 | 12.0 | 0.262 | 35,122.7 | 15,931.4 |
| 3 | 95.0 | 35.0 | 42.67 | 3.0 | 21.6 | 12.0 | 0.262 | 7,597.1 | 3,446.0 |
| 4 | 145.4 | 63.0 | 42.67 | 3.0 | 228.4 | 126.9 | 0.426 | 10,282.4 | 4,664.0 |
| 5 | 167.0 | 75.0 | 42.67 | 3.0 | 158.4 | 88.0 | 0.262 | 35,122.7 | 15,931.4 |
| 6 | 167.0 | 75.0 | 42.67 | 3.0 | 813.6 | 452.0 | 0.890 | 2,685.2 | 1,218.0 |
| 7 | 167.0 | 75.0 | 42.67 | 3.0 | 104.4 | 58.0 | 0.210 | 32,437.5 | 14,713.4 |
| 8 | 95.0 | 35.0 | 42.67 | 3.0 | 19.4 | 10.8 | 0.426 | 10,282.4 | 4,664.0 |
| 9 | 95.0 | 35.0 | 711.16 | 50.0 | 19.4 | 10.8 | 0.426 | 10,282.4 | 4,664.0 |
| 10 | 662.0 | 350.0 | 711.16 | 50.0 | 1,212.5 | 673.6 | 0.426 | 10,282.4 | 4,664.0 |
| 11 | 183.2 | 84.0 | 14.22 | 1.0 | 956.9 | 531.6 | 0.426 | 10,282.4 | 4,664.0 |
| 12 | 150.8 | 66.0 | 14.22 | 1.0 | 489.6 | 272.0 | 0.426 | 10,282.4 | 4,664.0 |

TABLE 1-continued

| Point | Temperature | | Pressure | | Enthalpy | | Concentration | Weight | |
|---|---|---|---|---|---|---|---|---|---|
| No. | °F. | °C. | psia | kg/cm² | BTU/lb | kcal/kg | lb/lb or kg/kg | lb/hr | kg/hr |
| 13 | 136.4 | 58.0 | 14.22 | 1.0 | 197.1 | 109.5 | 0.262 | 42,719.8 | 19,377.4 |
| 14 | 116.6 | 47.0 | 14.22 | 1.0 | 104.4 | 58.0 | 0.210 | 32,437.5 | 14,713.4 |
| 15 | 95.0 | 35.0 | 14.22 | 1.0 | 21.6 | 12.0 | 0.262 | 42,719.8 | 19,377.4 |
| 16 | 750.0 | 399.0 | — | — | — | — | gas | 91,386.0 | 41,452.0 |
| 17 | 213.3 | 100.7 | — | — | — | — | gas | 91,386.0 | 41,452.0 |
| 18 | 85.0 | 29.4 | — | — | — | — | water | 107,936.1 | 48,959.0 |
| 19 | 105.0 | 40.5 | — | — | — | — | " | 107,936.1 | 48,959.0 |
| 20 | 85.0 | 29.4 | — | — | — | — | " | 376,598.0 | 170,822.0 |
| 21 | 105.0 | 40.5 | — | — | — | — | " | 376,598.0 | 170,822.0 |

The parameters identified by point numbers 1 through 21 in the first column of Table 1 are those specifically identified by the corresponding numbers in FIG. 2.

This case study generated the following data:

(1) turbine output (at 75% efficiency)—774.7 Kw;
(2) total pump work—11.3 Kw;
(3) net output—763.4 Kw or 656.400 Kcal/hr;
(4) thermal efficiency—21.2%;
(5) second law efficiency—53.9%;
(6) exergy utilization efficiency—42.7%;
(7) internal cycle efficiency 71.9%; and
(8) name plate energy recovery ratio—14.6%.

As compared to a conventional Rankine cycle, the second law efficiency was calculated to be 53.9% for the system 10.2 as opposed to 42.8% for a conventional Rankine cycle. Similarly, the exergy utilization efficiency was calculated to be 42.7% for the system 10.2 of FIG. 2, as opposed to 34.2% for the conventional Rankine cycle. This improvement in efficiency would therefore allow for a reduction of installed cost per Kw of between about 40 and 60%.

In calculating the parameters for the system 10.2 of FIG. 2, the starting point was taken as point 11, namely the pressure of the spent gaseous working fluid. This was taken to be one atmosphere which is the lowest pressure which can conveniently handled without being concerned about subatmospheric sealing problems, etc.

Utilizing this pressure as the starting point, the temperature at point 15 would be 35° C. based on the temperature of the cooling water utilized. The concentration of the initial working fluid stream at point 15 would therefore be fixed from the water-ammonia enthalpy/-concentration diagrams.

The pressure of the initial working fluid stream would therefore be increase by the initial pump 50.2 to a high pressure at which the first distillation stream may be evaporated effectively in the first distillation stage D1, thereby insuring that the pressure is high enough for effective condensation in the first condensation stage C1.

The design studies which were performed, were not optimized either from the thermodynamic or from an economic point of view.

The parameters would, in practice, be varied to balance the effective utilization of high temperature and low temperature heat sources while balancing equipment and installation costs.

The theoretical calculations which were prepared for the case study, have demonstrated the embodiment of the invention as illustrated in FIG. 2, can provide substantial advantages over the conventional Rankine type cycle even where extremely high temperature waste heat sources are employed as the heating medium. Without wishing to be bound by theory, applicant believes that these advantages are provided by the effective utilization of high temperature heat in the evaporation stage, and low temperature heat in the distillation system thereby effectively utilizing the heat and limiting the magnitude of heat losses.

With reference to FIG. 3 of the drawings, reference numeral 10.3 refers to an alternative embodiment of a cycle or system in accordance with this invention.

The system 10.3 corresponds substantially with the systems 10.1 and 10.2. Corresponding parts are therefore indicated by corresponding reference numeral except that the suffix "0.3" has been employed in place of the suffix "0.2".

The system 10.3 again has a distillation system 24.3 which has been encircled in chain dotted lines to highlight the portions which constitute the distillation system 24.3.

The distillation system 24.3 includes two distillation units with the first distillation unit having a distillation stage D1, a separation stage S1 and a condensation stage C1, while the second distillation unit has a distillation stage D2, a separator stage S2 and a condensation stage C2.

In the system 10.3, cooling jacket water from the De Laval diesel engine would be utilized as the lower temperature heat source to cause partial distillation of the first distillation stream flowing along the line 54.3 into the distillation stage D1.

The partially distilled distillation stream flowing from the distillation stage D1, flows along the line 56.3 to the first separator stage S1. As before, the higher boiling fraction flows along the line 32.3 through the pressure reducing valve 34.3 and then through the line 36.3 to the main absorption stage 20.3. The first lower boiling fraction mixes with the first neutral stream flowing along the line 52.3 and is absorbed in the first neutral stream in the condensation stage C1.

A second high boiling fraction from the second distillation unit flows along line 63.3 through a pressure reducing valve 65.3 to the first condensation stage C1.

The first condensation stage C1 is cooled by means of cooling water at ambient temperature to ensure absorption of the first lower boiling fraction which is enriched with ammonia.

A second working fluid stream is therefore produced in the first condensation stage C1 and flows along the line 67.3 to a second pump 69.3. The second pump 69.3 increases the pressure of the second working fluid stream whereafter the stream is separated into a second neutral stream flowing along the line 71.3, and a second distillation stream flowing along the line 73.3.

The second distillation stream flows through the second distillation stage D2 in heat exchange relationship with the spent gaseous working fluid flowing along the line 18.3. Partial distillation occurs in the stage D2

On the downstream side of the initial pump 50.2, the initial working fluid stream is separated into a first neutral stream which flows along line 52.2, and a first distillation stream which flows along line 54.2.

The distillation system 24.2 includes a first distillation stage D1 which is in the form of a heat exchanger to place the first distillation stream flowing along the line 54.2 in heat exchange relationship with spent gaseous working fluid flowing along the line 18.2.

Relatively lower temperature heat from the spent gaseous working fluid causes partial distillation of the first distillation stream in the first distillation stage D1 to generate working fluid fractions of differing compositions which flow along the line 56.2 to a first separator stage S1.

The first separator stage S1 may be provided by a separator stage of any conventional suitable type known to those skilled in the art.

In the separator stage S1 the working fluid fractions become separated into a lower boiling fraction and a higher boiling fraction. The higher boiling fraction which is impoverished with respect to the ammonia, flows out of the distillation system 24.2 along line 32.2 through the pressure release valve 34.2 and then through the line 36.2 to the main absorption stage 20.2.

The lower boiling fraction which is enriched with respect to the ammonia flows along line 58.2 and is mixed with the first neutral stream flowing along line 52.2 to enrich the first neutral stream. The lower boiling fraction is therefore absorbed in the first neutral stream in a first condensation stage C1 to form a first rich solution stream which leaves the first condensation stage C1.

In the system 10.2, the distillation system 24.2 comprises only a single distillation unit. The first rich solution stream which leaves the first condensation stage C1 therefore constitutes the main rich solution stream which leaves this distillation system 24.2 along the line 26.2 and flows to the main rich solution pump 28.2 where its pressure is increased prior to evaporation in the main evaporation stage 12.2.

In the cycle 10.2, cooling water at ambient temperature is employed both in the main absorption stage 20.2 and in the first condensation stage C1 to effect absorption of gaseous fractions into liquid fractions in these two stages. For the relatively higher temperature heat to effect evaporation of the main rich solution in the main evaporation stage 12.2, exhaust gases from a De Laval diesel engine is utilized to flow along the line 40.2.

A case study was prepared to illustrate the recovery of waste heat from a De Laval diesel engine. Waste heat is available from such an engine in the form of exhaust gas, jacket water and lubrication oil. In the embodiment illustrated in FIG. 2 of the drawings, only the heat available from the exhaust gas was utilized as a heat source since the lower temperature heat was not required.

In the embodiment illustrated in FIG. 3, however, heat available in the form of exhaust gas as well as heat available in the form of jacket water was utilized as the heat source.

The De Laval engine was a model DSRV-12-4 of Transamerica De Laval, Inc. "Enterprise". It had a gross bhp rating of 7,390 and a net bhp rating of 7,313.

The available heat sources which could be utilized from the waste heat of the De Laval diesel engine are as follows:

| EXHAUST GAS | | |
|---|---|---|
| T1 | 750° F. | 319.9° C. |
| T2 | 200° | 93.3° C. |
| H (heat in exhaust gas above 200° F.) | 12,566,600 BTU/hr. | 3,166,472 Kcal/hr. |

| JACKET WATER | | |
|---|---|---|
| T1 | 175° F. | 79.44° C. |
| T2 | 163° F. | 72.78° C. |
| H | 8,440,300 BTU/hr. | 2,027,130 Kcal/hr. |

| LUBRICATING OIL | | |
|---|---|---|
| T1 | 175° F. | 79.44° C. |
| T2 | 153° F. | 67.22° C. |
| H | 2,413,290 BTU/hr. | 608,139 Kcal/hr. |

EXERGY IN AVAILABLE HEAT SOURCE

Exergy is defined at the initial cooling water temperature of 85° F. and final temperature of 105° F. Exergy in heat sources having an initial temperature less than 160° F. is considered de minimus and has been ignored. The exergy in available heat sources is:

(a) exhaust gas—1,431.4 Kw or 1,230,607 Kw/hr;
(b) jacket water—277.9 Kw or 238,190 Kcal/hr;
(c) lubrication oil—78.3 Kw or 67,329 Kcal/hr;
(d) total—1,787.5 Kw or 1,536.846 Kcal/hr.

In the case study which was performed, the temperatures, pressures and concentrations were ascertained from water-ammonia enthalpy/concentration diagrams which are available in the literature.

The case study which was calculated on the basis of the system 10.2 as illustrated in FIG. 2, had the parameters as set out below in Table 1.

TABLE 1

| Point | Temperature | | Pressure | | Enthalpy | | Concentration | Weight | |
|---|---|---|---|---|---|---|---|---|---|
| No. | °F. | °C. | psia | kg/cm² | BTU/lb | kcal/kg | lb/lb or kg/kg | lb/hr | kg/hr |
| 1 | 95.0 | 35.0 | 42.67 | 3.0 | 21.6 | 12.0 | 0.262 | 42,719.8 | 19,377.4 |
| 2 | 95.0 | 35.0 | 42.67 | 3.0 | 21.6 | 12.0 | 0.262 | 35,122.7 | 15,931.4 |
| 3 | 95.0 | 35.0 | 42.67 | 3.0 | 21.6 | 12.0 | 0.262 | 7,597.1 | 3,446.0 |
| 4 | 145.4 | 63.0 | 42.67 | 3.0 | 228.4 | 126.9 | 0.426 | 10,282.4 | 4,664.0 |
| 5 | 167.0 | 75.0 | 42.67 | 3.0 | 158.4 | 88.0 | 0.262 | 35,122.7 | 15,931.4 |
| 6 | 167.0 | 75.0 | 42.67 | 3.0 | 813.6 | 452.0 | 0.890 | 2,685.2 | 1,218.0 |
| 7 | 167.0 | 75.0 | 42.67 | 3.0 | 104.4 | 58.0 | 0.210 | 32,437.5 | 14,713.4 |
| 8 | 95.0 | 35.0 | 42.67 | 3.0 | 19.4 | 10.8 | 0.426 | 10,282.4 | 4,664.0 |
| 9 | 95.0 | 35.0 | 711.16 | 50.0 | 19.4 | 10.8 | 0.426 | 10,282.4 | 4,664.0 |
| 10 | 662.0 | 350.0 | 711.16 | 50.0 | 1,212.5 | 673.6 | 0.426 | 10,282.4 | 4,664.0 |
| 11 | 183.2 | 84.0 | 14.22 | 1.0 | 956.9 | 531.6 | 0.426 | 10,282.4 | 4,664.0 |
| 12 | 150.8 | 66.0 | 14.22 | 1.0 | 489.6 | 272.0 | 0.426 | 10,282.4 | 4,664.0 |

TABLE 1-continued

| Point | Temperature | | Pressure | | Enthalpy | | Concentration | Weight | |
|---|---|---|---|---|---|---|---|---|---|
| No. | °F. | °C. | psia | kg/cm² | BTU/lb | kcal/kg | lb/lb or kg/kg | lb/hr | kg/hr |
| 13 | 136.4 | 58.0 | 14.22 | 1.0 | 197.1 | 109.5 | 0.262 | 42,719.8 | 19,377.4 |
| 14 | 116.6 | 47.0 | 14.22 | 1.0 | 104.4 | 58.0 | 0.210 | 32,437.5 | 14,713.4 |
| 15 | 95.0 | 35.0 | 14.22 | 1.0 | 21.6 | 12.0 | 0.262 | 42,719.8 | 19,377.4 |
| 16 | 750.0 | 399.0 | — | — | — | — | gas | 91,386.0 | 41,452.0 |
| 17 | 213.3 | 100.7 | — | — | — | — | gas | 91,386.0 | 41,452.0 |
| 18 | 85.0 | 29.4 | — | — | — | — | water | 107,936.1 | 48,959.0 |
| 19 | 105.0 | 40.5 | — | — | — | — | " | 107,936.1 | 48,959.0 |
| 20 | 85.0 | 29.4 | — | — | — | — | " | 376,598.0 | 170,822.0 |
| 21 | 105.0 | 40.5 | — | — | — | — | " | 376,598.0 | 170,822.0 |

The parameters identified by point numbers 1 through 21 in the first column of Table 1 are those specifically identified by the corresponding numbers in FIG. 2.

This case study generated the following data:

(1) turbine output (at 75% efficiency)—774.7 Kw;
(2) total pump work—11.3 Kw;
(3) net output—763.4 Kw or 656.400 Kcal/hr;
(4) thermal efficiency—21.2%;
(5) second law efficiency—53.9%;
(6) exergy utilization efficiency—42.7%;
(7) internal cycle efficiency 71.9%; and
(8) name plate energy recovery ratio—14.6%.

As compared to a conventional Rankine cycle, the second law efficiency was calculated to be 53.9% for the system 10.2 as opposed to 42.8% for a conventional Rankine cycle. Similarly, the exergy utilization efficiency was calculated to be 42.7% for the system 10.2 of FIG. 2, as opposed to 34.2% for the conventional Rankine cycle. This improvement in efficiency would therefore allow for a reduction of installed cost per Kw of between about 40 and 60%.

In calculating the parameters for the system 10.2 of FIG. 2, the starting point was taken as point 11, namely the pressure of the spent gaseous working fluid. This was taken to be one atmosphere which is the lowest pressure which can conveniently handled without being concerned about subatmospheric sealing problems, etc.

Utilizing this pressure as the starting point, the temperature at point 15 would be 35° C. based on the temperature of the cooling water utilized. The concentration of the initial working fluid stream at point 15 would therefore be fixed from the water-ammonia enthalpy/-concentration diagrams.

The pressure of the initial working fluid stream would therefore be increase by the initial pump 50.2 to a high pressure at which the first distillation stream may be evaporated effectively in the first distillation stage D1, thereby insuring that the pressure is high enough for effective condensation in the first condensation stage C1.

The design studies which were performed, were not optimized either from the thermodynamic or from an economic point of view.

The parameters would, in practice, be varied to balance the effective utilization of high temperature and low temperature heat sources while balancing equipment and installation costs.

The theoretical calculations which were prepared for the case study, have demonstrated the embodiment of the invention as illustrated in FIG. 2, can provide substantial advantages over the conventional Rankine type cycle even where extremely high temperature waste heat sources are employed as the heating medium. Without wishing to be bound by theory, applicant believes that these advantages are provided by the effective utilization of high temperature heat in the evaporation stage, and low temperature heat in the distillation system thereby effectively utilizing the heat and limiting the magnitude of heat losses.

With reference to FIG. 3 of the drawings, reference numeral 10.3 refers to an alternative embodiment of a cycle or system in accordance with this invention.

The system 10.3 corresponds substantially with the systems 10.1 and 10.2. Corresponding parts are therefore indicated by corresponding reference numeral except that the suffix "0.3" has been employed in place of the suffix "0.2".

The system 10.3 again has a distillation system 24.3 which has been encircled in chain dotted lines to highlight the portions which constitute the distillation system 24.3.

The distillation system 24.3 includes two distillation units with the first distillation unit having a distillation stage D1, a separation stage S1 and a condensation stage C1, while the second distillation unit has a distillation stage D2, a separator stage S2 and a condensation stage C2.

In the system 10.3, cooling jacket water from the De Laval diesel engine would be utilized as the lower temperature heat source to cause partial distillation of the first distillation stream flowing along the line 54.3 into the distillation stage D1.

The partially distilled distillation stream flowing from the distillation stage D1, flows along the line 56.3 to the first separator stage S1. As before, the higher boiling fraction flows along the line 32.3 through the pressure reducing valve 34.3 and then through the line 36.3 to the main absorption stage 20.3. The first lower boiling fraction mixes with the first neutral stream flowing along the line 52.3 and is absorbed in the first neutral stream in the condensation stage C1.

A second high boiling fraction from the second distillation unit flows along line 63.3 through a pressure reducing valve 65.3 to the first condensation stage C1.

The first condensation stage C1 is cooled by means of cooling water at ambient temperature to ensure absorption of the first lower boiling fraction which is enriched with ammonia.

A second working fluid stream is therefore produced in the first condensation stage C1 and flows along the line 67.3 to a second pump 69.3. The second pump 69 3 increases the pressure of the second working fluid stream whereafter the stream is separated into a second neutral stream flowing along the line 71.3, and a second distillation stream flowing along the line 73.3.

The second distillation stream flows through the second distillation stage D2 in heat exchange relationship with the spent gaseous working fluid flowing along the line 18.3. Partial distillation occurs in the stage D2 so that the partially distilled second distillation stream flows along the line 75.3 to a second separator stage S2. The higher boiling fraction from the separator stage S2 constitutes the second higher boiling fraction which flows along line 63.3 to the first condensation stage C1. The second lower boiling fraction flows along line 77.3 and is absorbed into the second neutral stream in the second condensation stage C2. The second condensation stage C2 is again cooled with cooling water at ambient temperature.

The resultant main rich solution emerges from the distillation system 24.3 along line 26.3 and enters the pump 28.3 where it is pumped to an appropriate pressure for complete or substantially complete evaporation in the main evaporation stage 12.3 where it is evaporated with exhaust gases from the DeLeval engine.

As in the case of the system 10.2, a design study was performed on the system 10.3 utilizing not only the exhaust gases from the De Laval engine as the high temperature heat source, but also utilizing the jacket water from the DeLaval engine as the low temperature heat source for use in the distillation system 24.3.

The parameters for the theoretical calculations which were performed again utilizing standard ammonia-water enthalpy/concentration diagrams, are set out in Table 2 below.

In Table 2 below, points 1 through 35 in the first column correspond with the specifically marked points in FIG. 3.

TABLE 2

| Point | Temperature | | Pressure | | Enthalpy | | Concentration | Weight | |
|---|---|---|---|---|---|---|---|---|---|
| No | °F. | °C. | psia | kg/cm² | BTU/lb | kcal/kg | lb/lb or kg/kg | lb/hr | kg/hr |
| 1 | 95.0 | 35.0 | 995.60 | 70.0 | 34.2 | 19.0 | 0.50 | 12,015.2 | 5,450.0 |
| 2 | 608.0 | 320.0 | 995.60 | 70.0 | 1,080.0 | 600.0 | 0.50 | 12,015.2 | 5,450.0 |
| 3 | 174.2 | 79.0 | 14.22 | 1.0 | 831.4 | 461.9 | 0.50 | 12,015.2 | 5,450.0 |
| 4 | 200.0 | 93.3 | — | — | — | — | exhaust gas | 91,386.0 | 41,452.0 |
| 5 | 750.0 | 399.0 | — | — | — | — | exhaust gas | 91,386.0 | 41,452.0 |
| 6 | 138.2 | 59.0 | 14.22 | 1.0 | 492.3 | 273.8 | 0.50 | 12,015.2 | 5,450.0 |
| 7 | 140.0 | 60.0 | 14.22 | 1.0 | 229.5 | 127.5 | 0.26 | 38,228.2 | 17,340.9 |
| 8 | 95.0 | 35.0 | 14.22 | 1.0 | 21.2 | 11.8 | 0.26 | 38,228.2 | 17,340.9 |
| 9 | 95.0 | 35.0 | 28.45 | 2.0 | 21.2 | 11.8 | 0.26 | 38,228.2 | 17,340.9 |
| 10 | 95.0 | 35.0 | 28.45 | 2.0 | 21.2 | 11.8 | 0.26 | 6,676.2 | 3,027.8 |
| 11 | 95.0 | 35.0 | 28.45 | 2.0 | 21.2 | 11.8 | 0.26 | 31,555.0 | 14,313.1 |
| 12 | 167.0 | 75.0 | 28.45 | 2.0 | 234.0 | 130.0 | 0.26 | 31,555.0 | 14,313.1 |
| 13 | 167.0 | 75.0 | 28.45 | 2.0 | 847.8 | 471.0 | 0.80 | 5,340.0 | 2,422.2 |
| 14 | 167.0 | 75.0 | 28.45 | 2.0 | 108.9 | 60.5 | 0.15 | 26,214.9 | 11,890.9 |
| 15 | 140.0 | 60.0 | 14.22 | 1.0 | 108.9 | 60.5 | 0.15 | 26,214.9 | 11,890.9 |
| 16 | 122.0 | 50.0 | 28.45 | 2.0 | 388.6 | 215.9 | 0.50 | 12,015.2 | 5,450.0 |
| 17 | 129.2 | 54.0 | 28.45 | 2.0 | 204.3 | 113.5 | 0.36 | 33,041.8 | 14,987.5 |
| 18 | 95.0 | 35.0 | 28.45 | 2.0 | 16.6 | 9.2 | 0.36 | 33,041.8 | 14,987.5 |
| 19 | 95.0 | 35.0 | 64.00 | 4.5 | 16.6 | 9.2 | 0.36 | 33,041.8 | 14,987.5 |
| 20 | 95.0 | 35.0 | 64.00 | 4.5 | 16.6 | 9.2 | 0.36 | 24,003.7 | 10,887.9 |
| 21 | 95.0 | 35.0 | 64.00 | 4.5 | 16.6 | 9.2 | 0.36 | 9,038.1 | 4,099.6 |
| 22 | 136.4 | 58.0 | 64.00 | 4.5 | 211.0 | 117.2 | 0.50 | 12,015.2 | 5,450.0 |
| 23 | 95.0 | 35.0 | 64.00 | 4.5 | 34.2 | 19.0 | 0.50 | 12,015.2 | 5,450.0 |
| 24 | 167.0 | 75.0 | 64.00 | 4.5 | 186.1 | 103.4 | 0.36 | 24,003.7 | 10,887.9 |
| 25 | 167.0 | 75.0 | 64.00 | 4.5 | 801.0 | 445.0 | 0.92 | 2,977.1 | 1,350.4 |
| 26 | 167.0 | 75.0 | 64.00 | 4.5 | 99.0 | 55.0 | 0.28 | 21,026.6 | 9,537.5 |
| 27 | 132.8 | 56.0 | 28.45 | 2.0 | 99.0 | 55.0 | 0.28 | 21,026.6 | 9,537.5 |
| 28 | 175.0 | 79.4 | — | — | — | — | jacket water | 559,924.0 | 253,977.3 |
| 29 | 163.0 | 72.8 | — | — | — | — | jacket water | 559,924.0 | 253,977.3 |
| 30 | 85.0 | 29.4 | — | — | — | — | cooling water | 381,156.0 | 172,889.5 |
| 31 | 105.0 | 40.5 | — | — | — | — | " | 381,156.0 | 172,889.5 |
| 32 | 85.0 | 29.4 | — | — | — | — | " | 399,908.0 | 181,395.9 |
| 33 | 105.0 | 40.5 | — | — | — | — | " | 399,908.0 | 181,395.9 |
| 34 | 85.0 | 29.4 | — | — | — | — | " | 106,775.6 | 48,433.5 |
| 35 | 105.0 | 40.5 | — | — | — | — | " | 106,775.6 | 48,433.5 |

In relation to this case study, the following data was calculated:

1. Turbine output (at 75% efficiency)—875.4 Kw.
2. Total pump work—14.5 Kw.
3. Net output—860.9 Kw or 740,159 Kcal/hr.
4. Thermal efficiency—15.2%.
5. Second law efficiency—51.9%.
6. Exergy utilization efficiency—48.2%.
7. Internal cycle efficiency—69.2%.
8. Name plate energy recovery ratio—16.5%.

In comparing the theoretical calculation for the cycle of system 10.3 with that of a conventional Rankine cycle, it was found that the second law efficiency of the cycle 10.3 was 51.9% as opposed to 42.8% for the conventional Rankine cycle. It was further calculated that the exergy utilization efficiency for the cycle 10.3 was 48.2% as opposed to 34.2% for the conventional Rankine cycle. This improvement over the cycle 10.2 is believed to be as a result of the more effective utilization of the lower temperature waste heat generated by the DeLaval diesel engine during use.

The embodiment of the cycle illustrated in FIG. 3 would therefore again provide the advantage that the cost per installed kilowatt would be reduced by about 50 to 60% in relation to a typical conventional Rankine cycle. It must be appreciated that this is based essentially on theoretical calculations and that the actual installed cost per kilowatt will vary depending upon, design, location and size of plant.

The design studies performed on the cycles 10.2 and 10.3, nevertheless indicate that waste heat from internal combustion engines could be converted economically to useful energy output in a quantity ranging from about 15 to 20% of nameplate capacity of the primary engine using conventionally available component equipment, but using applicant's improved heat utilization in applicant's thermodynamic cycles or systems.

Figure 4:
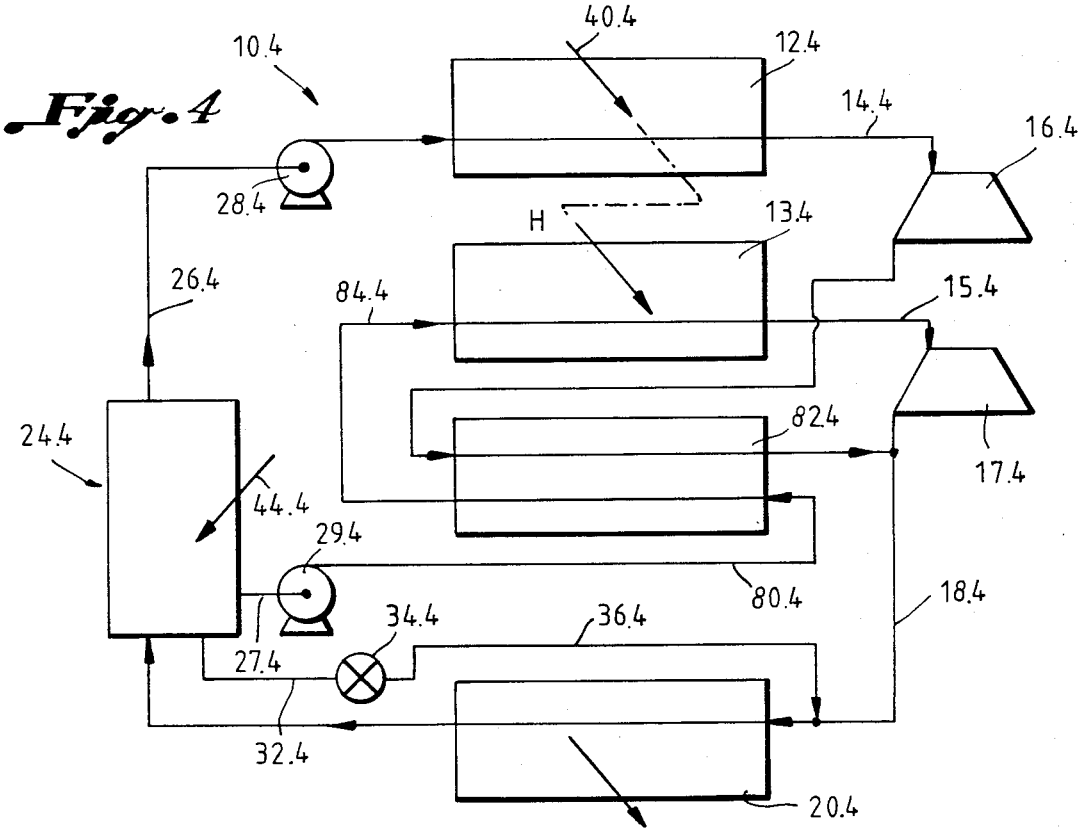
FIG. 4 shows a simplified schematic representation of an alternative system for carrying out the method of this invention.

With reference to FIG. 4 of the drawings, reference numeral 10.4 refers generally to yet a further alternative embodiment in accordance with this invention.

The system 10.4 corresponds generally with the system 10.1. Corresponding parts are therefore indicated by corresponding reference numerals except that the suffix "0.4" has been employed in place of the suffix "0.1".

The cycle or system 10.4 would be utilized where the waste heat source available for use, is available at such a high temperature that it could evaporate the main rich solution even where the pressure of that solution has been increased to a pressure far in excess of that which can conveniently be handled by the main evaporator 12 or by the turbine 16.

The cycle 10.4 is therefore designed to utilize such heat in an effective manner without providing pressure which cannot conveniently be handled by the evaporator and turbine.

In the system 10.4, the distillation system 24.4 produces, as before, a lean solution which emerges from the distillation system 24.4 and flows along line 32.4, through pressure reducing valve 34.4, along line 36.4 and into the main absorption stage 20.4.

In addition, however, the distillation system 24.4 produces two rich solution streams having differing compositions. The one rich solution liquid stream which is the least enriched with the low boiling ammonia, and is therefore a higher boiling solution than the remaining rich solution, is fed along line 26.4 to the pump 28.4 and is evaporated in the main evaporation stage 12.4 using the very high temperature available heat source. The evaporated charged gaseous working medium produced in the main evaporation stage 12.4 is fed through a first turbine 16.4 to release energy therein.

The second rich solution liquid stream which is produced in the distillation system 24.4, and which is more enriched with the low boiling ammonia and is therefore a lower boiling fluid than the other rich solution stream, flows along line 27.4 to a pump 29.4 where its pressure is increased. From there it flows along line 80.4 through a preheater 82.4 where it flows in heat exchange relationship with the spent working fluid from the turbine 16.4. Thereafter it flows along line 84.4 into a second main evaporation stage 13.4 where it is evaporated with slightly lower temperature high temperature heat which is recovered from the main evaporation stage 12.4, to evaporate it. Since it is more enriched with low boiling ammonia than the remaining rich solution stream, it can be evaporated effectively utilizing a lower temperature heat source than utilized in the main evaporation stage 12.4.

The evaporation stage 13.4 therefore produces a second charged working fluid which is fed to a second turbine 17.4 to release energy. This spent working fluid flows with the spent working fluid from the turbine 16.4 to the main absorption stage 20.4 for absorption in the lean solution.

The one rich solution stream which flows along the line 26.4 may, in an embodiment of the invention, have the same composition as the stream which leaves the absorption stage 20.4 depending upon the available heat source and the operating conditions.

Figure 5:
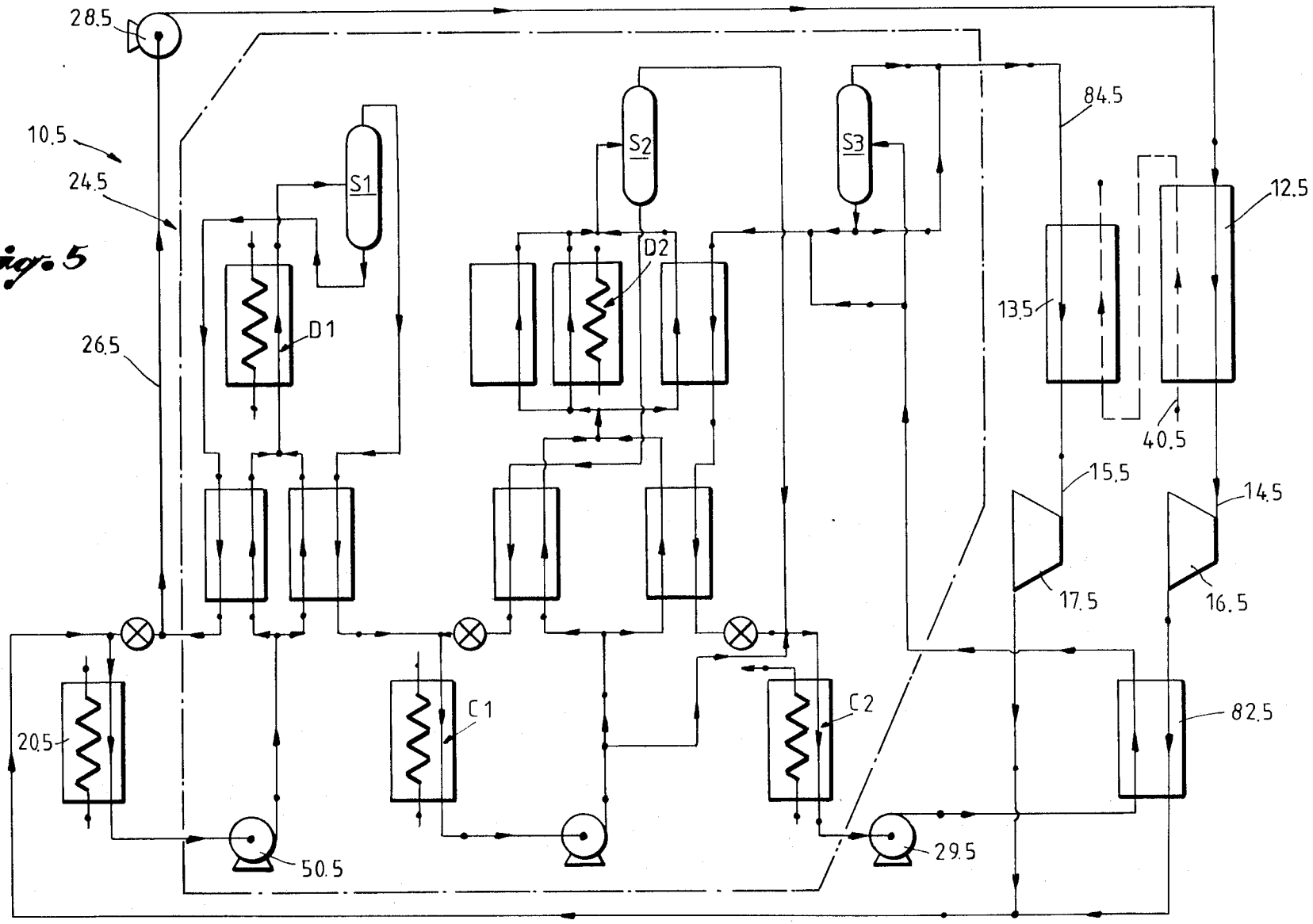
FIG. 5 shows a more complete schematic representation of one embodiment in accordance with the system of FIG. 4.

The system 10.4 is set out in more detail in FIG. 5 and is identified therein by reference numeral 10.5.

The distillation system 24.5 is again identified by being encircled with chain dotted lines. The distillation system 24.5 includes a plurality of distillation units comprising main distillation stages D1 and D2, main condensation stages C1 and C2, and a plurality of separation stages S1, S2 and S3.

A design calculation was performed upon the system 10.5 utilizing exhaust gas, jacket water and lubricating oil from a DeLaval diesel engine as available heat sources. This design calculation provided a calculated second law efficiency of 52.6% as opposed to a second law efficiency for a conventional rankine cycle of 42.8%. It further provided a calculated exergy utilization efficiency of about 51.8% as opposed to a conventional rankine cycle exergy utilization efficiency of 34.2%.

The embodiment of FIG. 5 illustrates how the parameters of the system of this invention may be varied to effectively utilize a large range of available heat sources ranging from very high temperature available heat to low temperature available heat.

For each application of the invention, available heat sources will have to be balanced against specific equipment costs, to arrive at the most appropriate parameters for each application utilizing appropriate multicomponent diagrams for the particular working fluid employed.

The embodiments of the invention as illustrated in the drawings, indicate that the invention can effectively utilize a plurality of different temperature heat sources to produce energy thereby providing for effective heat utilization and reduced heat loss.

Further calculations have been done with the system in accordance with applicant's invention as compared to a conventional rankine system. With a typical system in accordance with this invention, applicant found a second law efficiency of 59.7% as opposed to a second law efficiency of 29.7% for a typical rankine cycle when utilizing surface ocean water and deep ocean water as the heating and cooling mediums for a typical ocean thermal energy conversion system.

In further calculations performed on a heat source in the form of a solar pond, applicant calculated a second law efficiency for applicant's invention of about 80% and an exergy utilization efficiency of about 80% as compared to a second law efficiency and an exergy utilization efficiency of a typical Rankine cycle of about 56%.

Figure 6:
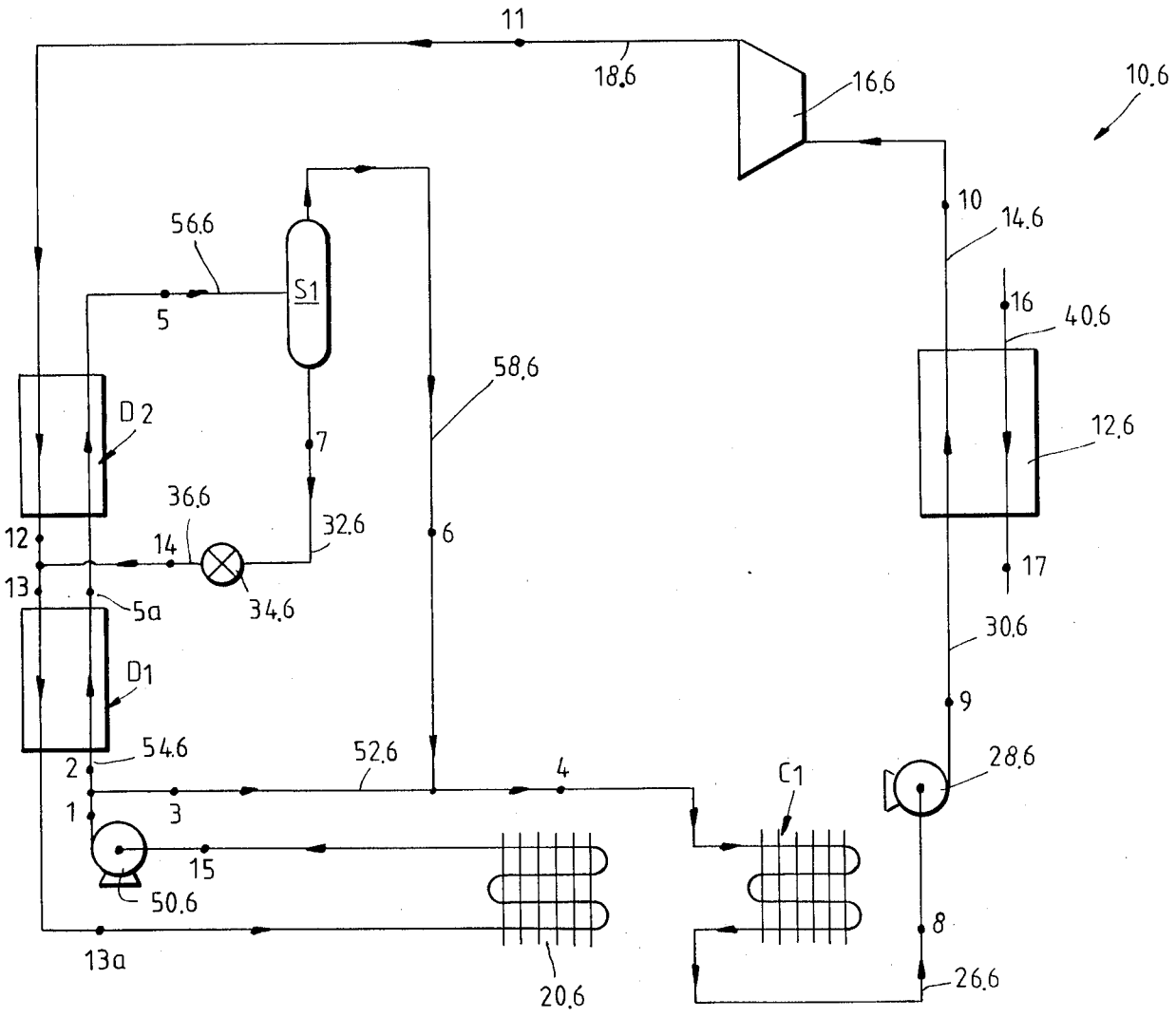
FIG. 6 shows a schematic representation of yet a further alternative system in accordance with this invention for utilizing heat in the form of geothermal heat.

With reference to FIG. 6 of the drawings, FIG. 6 indicates a typical cycle in accordance with applicant's invention employed for utilizing waste heat in the form of geothermal heat.

The embodiment of FIG. 6 corresponds essentially with the embodiment of FIG. 2. Corresponding parts have therefore been indicated by corresponding reference numerals except that the suffix "0.6" has been used in place of the suffix "0.2".

The system or cycle 10.6 was designed on a theoretical basis for utilization of a heat source in the form of geothermal heat from a site in the United States known as the East Mesa geothermal site.

The relatively high temperature heat is fed to the main evaporation stage 12.6 as indicated by reference numeral 40.6 in the form of a hot geothermal brine solution which cools from 335° F. (168.3° C.) to 134.8° F. (56.0° C.).

The cycle 10.6 includes a single distillation unit which includes two partial distillation stages D1 and D2.

The relatively lower temperature heat for the distillation system is provided by the spent gaseous working fluid which flows along line 18.6 and passes through the distillation stage D2. Thereafter, the higher boiling fraction from the separator S1 joins this flow where line 36.6 joins the line 18.6. This combined flow thereafter flows in heat exchange relationship with the first distillation stream through the partial distillation heat exchanger D1.

As in the prior systems, the expansion of the charged working fluid across the turbine 16.6 is controlled to achieve a reduced pressure corresponding to the pressure to which the pressure of the lean solution is reduced by the pressure reducing valve 34.6.

As in the case of the other systems, a design study was performed on the system or cycle 10.6 utilizing geothermal heat as the relatively high temperature heat source and utilizing ambient air as the cooling medium in the main absorption stage 20.6 and in the condensation stage C1.

The parameters for the theoretical calculations which were performed again utilizing standard ammonia-water enthalpy/concentration diagrams are set out in Table 3 below.

TABLE 3

| Point | Temperature | | Pressure | | Enthalpy | | Concentration | Weight | |
|---|---|---|---|---|---|---|---|---|---|
| No. | °F. | °C. | psia | kg/cm² | BTU/lb | kcal/kg | lb/lb or kg/kg | lb/hr | kg/hr |
| 1 | 81.0 | 27.2 | 113.8 | 8.0 | 16.6 | 9.2 | 0.521 | 90,358.1 | 40,985.6 |
| 2 | 81.0 | 27.2 | 113.8 | 8.0 | 16.6 | 9.2 | 0.521 | 78,491.2 | 35,602.9 |
| 3 | 81.0 | 27.2 | 113.8 | 8.0 | 16.6 | 9.2 | 0.521 | 11,866.9 | 5,382.7 |
| 4 | 95.0 | 35.0 | 113.8 | 8.0 | 379.6 | 210.9 | 0.750 | 23,592.2 | 10,701.2 |
| 5 | 149.0 | 65.0 | 113.8 | 8.0 | 174.6 | 97.0 | 0.521 | 78,491.2 | 35,602.9 |
| 5a | 107.6 | 42.0 | 113.8 | 8.0 | 64.1 | 35.6 | 0.521 | 78,491.2 | 35,602.9 |
| 6 | 149.0 | 65.0 | 113.8 | 8.0 | 747.0 | 415.0 | 0.982 | 11,725.3 | 5,318.5 |
| 7 | 149.0 | 65.0 | 113.8 | 8.0 | 75.24 | 41.8 | 0.440 | 66,765.9 | 30,284.4 |
| 8 | 81.0 | 27.2 | 113.8 | 8.0 | 97.2 | 54.0 | 0.750 | 23,582.2 | 10,701.2 |
| 9 | 81.0 | 27.2 | 284.5 | 20.0 | 97.2 | 54.0 | 0.750 | 23,592.2 | 10,701.2 |
| 10 | 307.4 | 153.0 | 284.5 | 20.0 | 928.8 | 516.0 | 0.750 | 23,592.2 | 10,701.2 |
| 11 | 201.2 | 94.0 | 49.8 | 3.5 | 837.7 | 465.4 | 0.750 | 23,592.2 | 10,701.2 |
| 12 | 116.6 | 47.0 | 49.8 | 3.5 | 469.8 | 261.0 | 0.750 | 23,592.2 | 10,701.2 |
| 13 | 116.6 | 47.0 | 49.8 | 3.5 | 178.2 | 99.0 | 0.521 | 90,358.1 | 40,985.6 |
| 13a | 104.0 | 40.0 | 49.8 | 3.5 | 138.1 | 76.7 | 0.521 | 90,358.1 | 40,985.6 |
| 14 | 116.6 | 47.0 | 49.8 | 3.5 | 75.2 | 41.8 | 0.440 | 66,765.9 | 30,284.4 |
| 15 | 81.0 | 27.2 | 49.8 | 3.5 | 16.6 | 9.2 | 0.521 | 90,358.1 | 40,985.6 |
| 16 | 335.0 | 168.3 | 118.0 | 8.3 | — | — | Brine | 97,200.0 | 44,089.0 |
| 17 | 134.8 | 56.0 | — | — | — | — | Brine | 97,200.0 | 44,089.0 |

The points 1 through 17 in the first column of Table 3 correspond with the specifically marked points in FIG. 6.

In relation to this case study, the following data was calculated:

| | | Rankine Cycle | Cycle 10.6 |
|---|---|---|---|
| 1 | turbine output (at 72% efficiency) | 530Kw | 630Kw |
| 2 | total pump work | 75Kw | 15Kw |
| 3 | net output | 455Kw | 615Kw |
| 4 | thermal efficiency | 8.6% | 10.7% |
| 5 | second law efficiency | 35.5% | 46.1% |
| 6 | exergy utilization efficiency | 33.3% | 44.5% |
| 7 | internal cycle efficiency | 49.2% | 64.0% |
| 8 | ratio of net output (Rankine Cycle = 1) | 1.0 | 1.35 |

This embodiment indicates a substantial theoretical improvement over the conventional Rankine cycle. It further illustrates the effective utilization of geothermal heat as a relatively higher temperature heat source for effecting complete evaporation of a high pressure liquid working fluid which has been enriched, and utilizing relatively lower temperature heat from spent gaseous working fluid as the low temperature heat source for causing partial distillation of portion of the initial working fluid stream to achieve effective enrichment thereof.

Applicant believes that by having working fluids of markedly different composition in the evaporation stage and in the main absorption stage, effective evaporation and heat utilization can be achieved in the evaporation stage for effective and complete evaporation of an enriched portion of a working fluid. Thereafter by utilizing a substantially impoverished fluid in the main absorption stage, the spent working fluid can be effectively condensed and thus regenerated for reuse.

It will be appreciated that heat sources can be obtained from various points in the system and from various heat and waste heat sources to provide for effective evaporation utilizing relatively higher temperature heat, and then utilizing spare relatively higher temperature heat and relatively lower temperature heat from other sources to effect partial distillation and thus enrichment of portion of the working fluid for effective evaporation.

What is claimed is:

1. A method of generating energy, which comprises:

(a) subjecting at least a portion of an initial multicomponent working fluid stream having an initial composition of lower and higher boiling components, to patial distillation at an intermediate pressure in a distillation system to distil or evaporate only part of the stream subjected to said distillation and thus generate an enriched vapor fraction which is enriched with a lower boiling component relatively to a main rich solution;

(b) mixing the enriched vapor fraction with part of the initial working fluid stream and absorbing it therein to produce at least one such main rich solution which is enriched relatively to the initial working fluid stream with respect to a lower temperature boiling component, and using a remaining part of the initial working fluid stream as at least one lean solution which is impoverished relatively to the main rich solution with respect to a lower temperature boiling component;

(c) increasing the pressure of the main rich solution to a charged high pressure level and evaporating the main rich solution to produce a charged gaseous main working fluid;

(d) expanding the charged gaseous main working fluid to a spent low pressure level to transform its energy into usable form; and (e) cooling and condensing the spent main working fluid in a main absorption stage by dissolving it in the lean solution at a pressure lower than the intermediate pressure to regenerate the initial working fluid.

2. A method according to claim 1, in which the main rich solution is evaporated substantially completely in a main evaporation stage to produce the charged gaseous working fluid.

3. A method according to claim 1, in which the main rich solution is evaporated using relatively higher temperature heat, and in which partial distillation is effected using relatively lower temperature heat which cannot be used effectively for evaporating the main rich solution.

4. A method according to claim 1, in which heat is recovered from the spent gaseous working fluid, and is at least partially used in the distillation system.

5. A method according to claim 1 or claim 4, in which heat is recovered from the spent gaseous working fluid and is at least partially employed in preheating the main rich solution prior to evaporation thereof.

6. A method according to claim 1, in which at least part of the lean solution is used as a second working fluid by having its pressure increased, by being evaporated in a second main evaporator stage, by being expanded to release energy, and by then being condensed with the other spent main working fluid and any remaining part of the lean solution in a main absorption stage.

7. A method according to claim 6, in which the second working fluid is expanded through a turbine type device independently of expansion of the main working fluid.

8. A method according to claim 1, in which the main rich solution is evaporated in a main evaporation stage using high temperature heat from a heat source, and in which at least a portion of a low temperature heat from that heat source is used to effect partial distillation of the working fluid.

9. A method according to claim 8, in which the heat from the heat source is used in series so that at least a portion of the low temperature heat comprises spent high temperature heat employed in evaporating the main rich solution.

10. A method according to claim 1, in which the initial working fluid stream is treated in the distillation system to produce in addition to the lean solution, a plurality of rich solution streams having differing compositions, and in which the rich solution streams are separately treated to increase their pressures, to evaporate them and to expand them, the evaporation of each rich solution stream being effected with a heat source temperature range appropriate for the specific composition range of the rich solution stream.

11. A method according to claim 10, in which each rich solution stream is evaporated completely.

12. A method according to claim 1, in which the initial multicomponent working fluid stream is subjected to partial distillation to produce the enriched vapor fraction, and in which the enriched vapor fraction is mixed with a sufficient part of the remaining working fluid stream to regenerate a consistent quantity of main rich solution having a consistent concentration of lower and higher boiling fractions.

13. A method according to claim 1, in which the initial multicomponent working fluid stream is subjected to partial distillation to distil part thereof to produce the enriched vapor fraction, and in which the mixture of the enriched vapor fraction and of part of the remaining working fluid stream is cooled in a condenser to produce the main rich solution.

14. A method according to claim 1, in which the working fluid stream comprises a mixture of water and ammonia.

15. A method according to claim 1, in which the initial multicomponent working fluid stream is subjected to partial distillation by using relatively lower temperature heat, and in which the main rich solution is evaporated using a relatively higher temperature heat.

16. A method according to claim 15, in which the relatively lower temperature heat is obtained from:

(a) a lower temperature portion of the relatively higher temperature heat;

(b) a portion of the relatively higher temperature heat which is not utilized for evaporating the main rich solution;

(c) heat from a relatively lower temperature heat source;

(d) heat recovered from the spent gaseous working fluid;

(e) heat recovered from the main absorption stage; or (f) from several of these sources.

17. A method according to claim 16, in which the relatively lower temperature heat is distributed between the distillation system and a lower temperature portion of a main evaporation stage to preheat the main rich solution prior to evaporation thereof in a main evaporation stage.

18. A method according to claim 15, in which relatively lower temperature heat is obtained partly from heat released by the spent gaseous working fluid.

19. A method according to claim 18, in which at least part of such heat is used for preheating the rich solution.

20. A method according to claim 1, which includes the steps of:

(a) dividing the initial working fluid stream into a first neutral stream and a first distillation stream;

(b) subjecting the first distillation stream to partial distillation in the distillation system to evaporate part of the stream and thus produce the enriched vapor fraction as a first lower boiling vapor fraction and the remainder of the first distillation stream as a first higher boiling liquid fraction;

(c) removing the first higher boiling liquid fraction from the distillation system to constitute the lean solution; and (d) absorbing the first lower boiling vapor fraction in the first neutral stream to enrich that stream to produce a first rich solution which is enriched with the lower boiling fraction relatively to the initial working fluid stream.

21. A method according to claim 20, which includes the step of withdrawing the first rich solution from the distillation system to constitute the main rich solution.

22. A method according to claim 20, in which the pressure of the initial working fluid stream is increased to the intermediate pressure before the stream is divided into the first neutral and first distillation streams.

23. A method according to claim 20, which includes the step of subjecting the first rich solution to at least one second distillation step by:

(a) mixing with the first rich solution a second higher boiling fraction recycled from a succeeding distillation stage of the distillation system to produce a second working fluid stream;
(b) increasing the pressure of the second working fluid stream to a second higher intermediate pressure;
(c) dividing the second working fluid stream into a second neutral stream and a second distillation stream;
(d) subjecting the second distillation stream to partial distillation in the distillation system to distil or evaporate part thereof and thus produce a second lower boiling vapor fraction, and to produce the second higher boiling liquid fraction which is recycled and mixed with the first rich solution; and
(e) absorbing the second lower boiling vapor fraction in the second neutral stream to produce a second rich solution having a greater enrichment of lower boiling fraction than the first rich solution.

24. A method according to claim 23, which includes the step of withdrawing the second rich solution from the distillation system to constitute the main rich solution.

25. A method according to claim 23, which includes the further step of subjecting the second rich solution to at least one further partial distillation system step to produce a subsequent rich solution having yet a greater enrichment than the second rich solution.

26. A method according to claim 4, or claim 6, or claim 25, in which the pressure of the working fluid stream is in each distillation stage increased to an intermediate pressure consistent with effective distillation of part of the distillation stream in that stage with the available lower temperature heat source, and consistent with effective condensation of the lower boiling fraction in the neutral stream with an available cooling medium in each distillation stage to produce a main rich solution which is enriched sufficiently for effective evaporation with the relatively higher temperature heat.

27. A method according to claim 26, in which the main rich solution is pumped to the highest pressure consistent with complete evaporation with the available higher temperature heat source and with the capacity of expansion means for expanding the gaseous working fluid.

28. A method of improving the heat utilization efficiency in a thermodynamic cycle using a multicomponent working fluid having components of lower and higher boiling point, which method comprises:
(a) utilizing relatively lower temperature heat to effect partial distillation of the working fluid by distilling or evaporating part of the working fluid to produce an enriched vapor fraction which is enriched with respect to the lower boiling component or components relatively to a main rich solution;
(b) mixing the enriched vapor fraction with only part of the remaining working fluid, and condensing the mixture to form such a main rich solution which is enriched with the lower boiling component relatively to the working fluid;
(c) increasing the pressure of the main rich solution and then utilizing relatively higher temperature heat to evaporate the main rich solution to produce a charged gaseous working fluid for expansion to transform its energy into usable form.

29. A method according to claim 28, which includes the step of expanding the charged gaseous working fluid to transform its energy into usable form, and of condensing the spent working fluid by absorbing it, in the presence of a cooling medium, in the remaining part of the working fluid which has been impoverished with respect to a lower boiling component and which was not mixed with the enriched vapor fraction.

30. A method according to claim 28 or claim 29, in which the relatively higher temperature heat is obtained from an available heat source, and in which the relatively lower temperature heat comprises spent relatively higher temperature heat.

31. A method according to claim 30, in which the relatively lower temperature heat further comprises heat extracted from the cycle, which cannot be effectively used in evaporating the enriched portion of the working fluid.

32. A method of generating energy, which comprises:
(a) feeding an initial multicomponent working fluid stream to a partial distillation system;
(b) increasing the pressure of the stream to an intermediate pressure;
(c) separating the stream into a neutral stream and a distillation stream;
(d) subjecting the distillation stream to partial distillation to distil or evaporate part of the distillation stream to produce working fluid fractions of differing compositions, the one fraction being an enriched vapor fraction which is enriched with at least one lower boiling component relatively to an enriched liquid stream, and the other fraction being a lean liquid solution;
(e) withdrawing the fraction comprising a lean liquid solution which is impoverished with respect to a lower boiling component, from the distillation system;
(f) mixing the fraction comprising an enriched vapor fraction which is enriched with respect to at least one lower boiling component, with the neutral stream and condensing it therein by means of a cooling medium to form such an enriched liquid stream;
(g) increasing the pressure of the enriched liquid stream;
(h) substantially evaporating the enriched liquid stream in an evaporation stage to produce a charged working fluid vapor;
(i) expanding the charged working fluid vapor to transform its energy into usable form and produce a spent working fluid; and
(j) mixing the spent working fluid with the lean liquid solution and condensing it therein in an absorption stage to regenerate the initial working fluid stream.

33. A method according to claim 32, which comprises reducing the pressure of the lean liquid solution to a starting pressure corresponding with that of the spent vapor before mixing them.

34. A method according to claim 32 or claim 33, in which the enriched liquid stream is evaporated using relatively higher temperature heat, and in which the distillation stream is partially distilled using relatively lower temperature heat.

35. A method according to claim 32, in which the working fluid comprises a binary fluid of water and ammonia.

36. A method of producing energy, which comprises:

(a) feeding an initial multicomponent working fluid stream to a partial distillation system at an initial pressure;

(b) increasing the pressure of the initial working fluid stream to an intermediate pressure;

(c) partially distilling the stream by means of relatively lower temperature heat to distil or evaporate off part of the stream and thus produce at least one impoverished working fluid stream liquid fraction which is impoverished with respect to a lower boiling component, and at least one enriched vapor fraction which is enriched with the lower boiling component relatively to an enriched liquid stream;

(d) withdrawing part of the working fluid stream, reducing its pressure to the initial pressure, and feeding it to an absorption stage;

(e) absorbing the enriched vapor fraction in a remaining part of the working fluid stream with the aid of cooling means to produce an enriched liquid stream;

(f) increasing the pressure of the enriched liquid stream to a charged pressure;

(g) evaporating the enriched liquid stream using a relatively higher temperature heat to produce a charged vapor;

(h) expanding the charged vapor to transform its energy into usuable form and produce a spent working fluid; and (i) absorbing the spent working fluid in the portion of the working fluid stream fed to the absorption stage with the aid of a cooling medium to regenerate the initial working fluid stream.

37. A method according to claim 36, in which a plurality of successive partial distillation steps are performed to successively increased enrichment and to produce a main enriched liquid stream.

* * * * *

UNITED STATES PATENT AND TRADEMARK OFFICE

CERTIFICATE OF CORRECTION

PATENT NO. : 4,489,563

DATED : December 25, 1984

INVENTOR(S) : Alexander I. Kalina

It is certified that error appears in the above-identified patent and that said Letters Patent is hereby corrected as shown below:

Column 18, line 49, delete "patial" and insert in lieu thereof --partial--.

Column 18, line 51, delete "said" and insert in lieu thereof --such--.

Column 21, line 31, delete "4, or claim 6" and insert in lieu thereof --20, or claim 23--.

Signed and Sealed this

*Ninth* Day of *July 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,489,563

DATED : December 25, 1984

INVENTOR(S) : Alexander I. Kalina

It is certified that error appears in the above-identified patent and that said Letters Patent is hereby corrected as shown below:

Column 1, line 3, insert --The United States Government has rights in the invention pursuant to an Agreement between the United States Department of Energy and Exergy Power, Inc. (wholly owned subidiary of Exergy, Inc.), successor to Kalina Technologies, Ltd., under Contract No. DE-AC03-76SF00700 for operation of the Exergy Technology Engineering Center (ETEC).--

Signed and Sealed this

Twenty-eighth Day of December, 1993

*Attest:*

*Attesting Officer*

Bruce Lehman

BRUCE LEHMAN

*Commissioner of Patents and Trademarks*